US005772011A

United States Patent [19]

Dumont

[11] Patent Number: 5,772,011

[45] Date of Patent: Jun. 30, 1998

[54] SWITCH-FUSE UNIT PROVIDED WITH A CONTROL BLOCK TO ACTIVATE AUXILIARY CIRCUITS

[75] Inventor: Roger Dumont, Benfeld, France

[73] Assignee: Socomec S.A., Benfeld, France

[21] Appl. No.: 725,185

[22] Filed: Oct. 1, 1996

[30] Foreign Application Priority Data

Oct. 3, 1995 [FR] France ..... 95 11829

[51] Int. Cl.[6] ..... H01H 3/42

[52] U.S. Cl. ..... 200/573; 337/10; 200/1 R; 200/30 R; 200/43.11

[58] Field of Search ..... 200/1, 2, 3, 4, 200/14, 15, 27 R, 28, 29, 30 R, 31 R, 31 A, 36, 37 R, 37 A, 38 B, 38 BA, 38 C, 43.04, 43.14, 43.15, 116, 50.07, 50.11, 400, 436, 437, 17 R, 18, 50.01, 50.32, 50.37, 50.4; 337/10, 7, 8, 11, 52, 63, 64, 65; 218/1, 2, 7, 14, 152, 153, 154, 8

[56] References Cited

U.S. PATENT DOCUMENTS 3,141,933 7/1964 Gauthier ..... 200/43.14
3,308,256 3/1967 Carlyle .
4,168,407 9/1979 Wiktor ..... 200/18
4,272,658 6/1981 Crosby ..... 200/17 R
5,138,296 8/1992 Borchardt et al. .

FOREIGN PATENT DOCUMENTS 1 038 634 3/1955 Germany .

*Primary Examiner*—Leo P. Picard
*Assistant Examiner*—Anatoly Vortman
*Attorney, Agent, or Firm*—Davis and Bujold

[57] ABSTRACT

The present invention relates to a switch-fuse unit provided with a control block to activate auxiliary circuits, this control block being provided with a rotating shaft fitted with a handle for selecting the unit's functions. This unit comprises an accessory device (10) mounted on the control block (11) and is provided with at least one microswitch (13) associated with an auxiliary circuit and a rotating part (18) mounted on said rotation shaft, this part being fitted with at least one activation cam (17). Each microswitch (13) comprises a mobile actuator (14) controlled by a plunger (15) via a support (12), this plunger (15) itself being controlled by the activation cam (17) associated with it, when the rotating part is moving. This accessory device (10) is particularly compact, easy to access and use and is suitable for all switching logics.

10 Claims, 3 Drawing Sheets

SWITCH-FUSE UNIT PROVIDED WITH A CONTROL BLOCK TO ACTIVATE AUXILIARY CIRCUITS

The present invention relates to a switch-fuse unit provided with a control block to activate auxiliary circuits, this control block being provided with a rotating shaft fitted with a handle for selecting the unit's functions.

It is an advantage for certain applications to be able to have means for controlling auxiliary circuits, and in particular this type of means, as long as they are compact and polyfunctional.

The present invention proposes an embodiment which meets this requirement.

In order to do so, the unit according to the invention is characterised in that it comprises an accessory device mounted on the control block and combined with said rotating shaft, this device being provided with a rotating part mounted on said rotating shaft, this part being fitted with at least one activation cam, and at least one microswitch associated with an auxiliary circuit.

According to a preferred embodiment, the accessory device comprises a support provided with at least one receptacle designed to house at least one plunger which is designed to cooperate with a mobile actuator of a microswitch.

It is an advantage for the support to have several receptacles and two plungers housed in two adjacent receptacles to be assocated with the same mobile actuator of a microswitch.

Preferably, the rotating part comprises several activation cams arranged in concentric circles.

Suitably, the rotating part comprises a disk bearing the activation cams, and a cylindrical drum which said rotating shaft crosses through. Preferably, said cylindrical drum has a cross bore with a square section the dimensions of which match those of the section of said rotating shaft and each activation cam corresponds to a plunger.

In the preferred embodiment, the unit comprises a plate for padlocking said rotating shaft.

The padlocking plate is suitably placed between the rotating part and the control block and has an opening crossed by said rotating shaft, this opening having a circular shaped part allowing the shaft to rotate freely and an elongated part with a square or rectangular section which locks this shaft.

The padlocking plate preferably slides between a first position corresponding to the free rotation of the rotating shaft and a second position which corresponds to the locking of the shaft.

Figure 1:
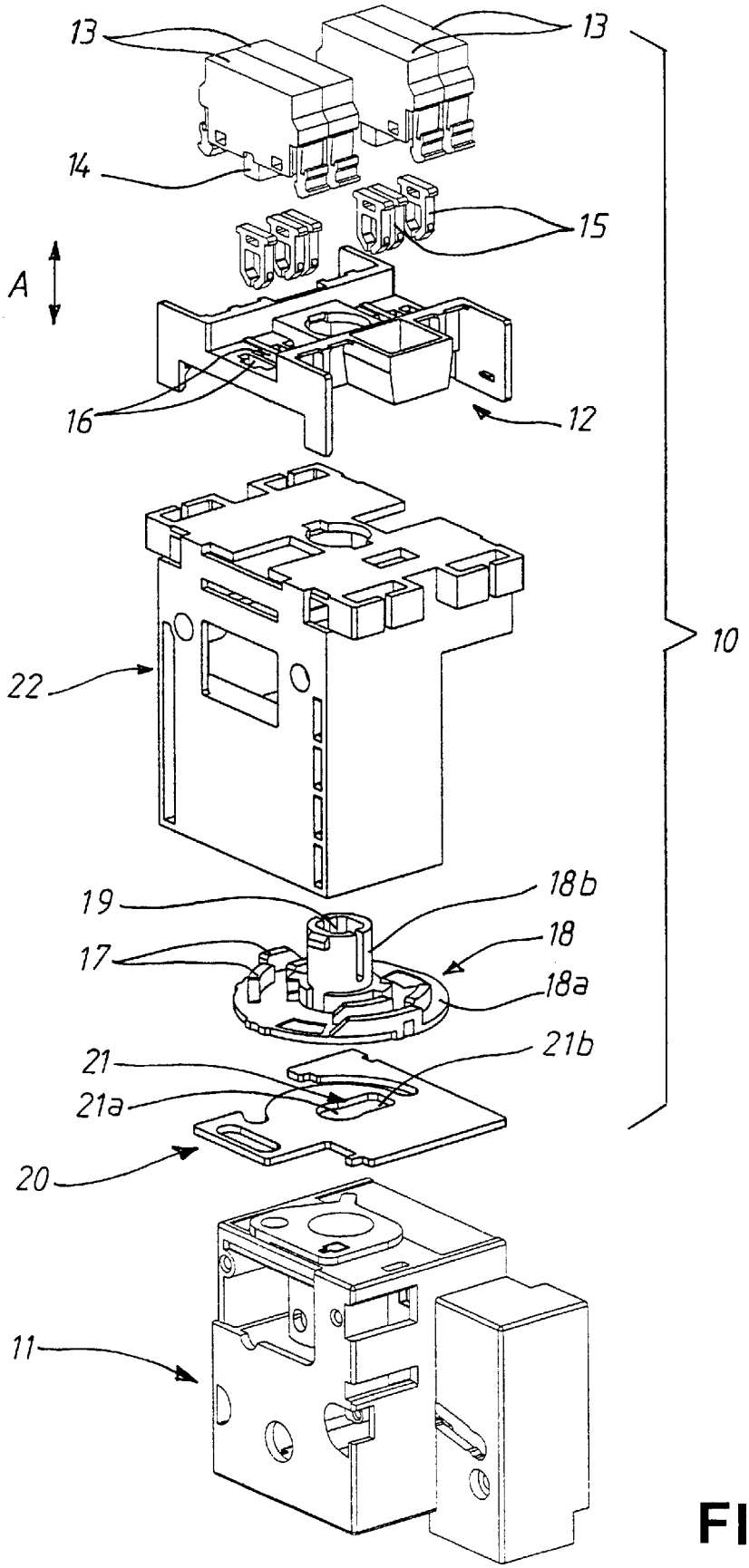
Figure 2:
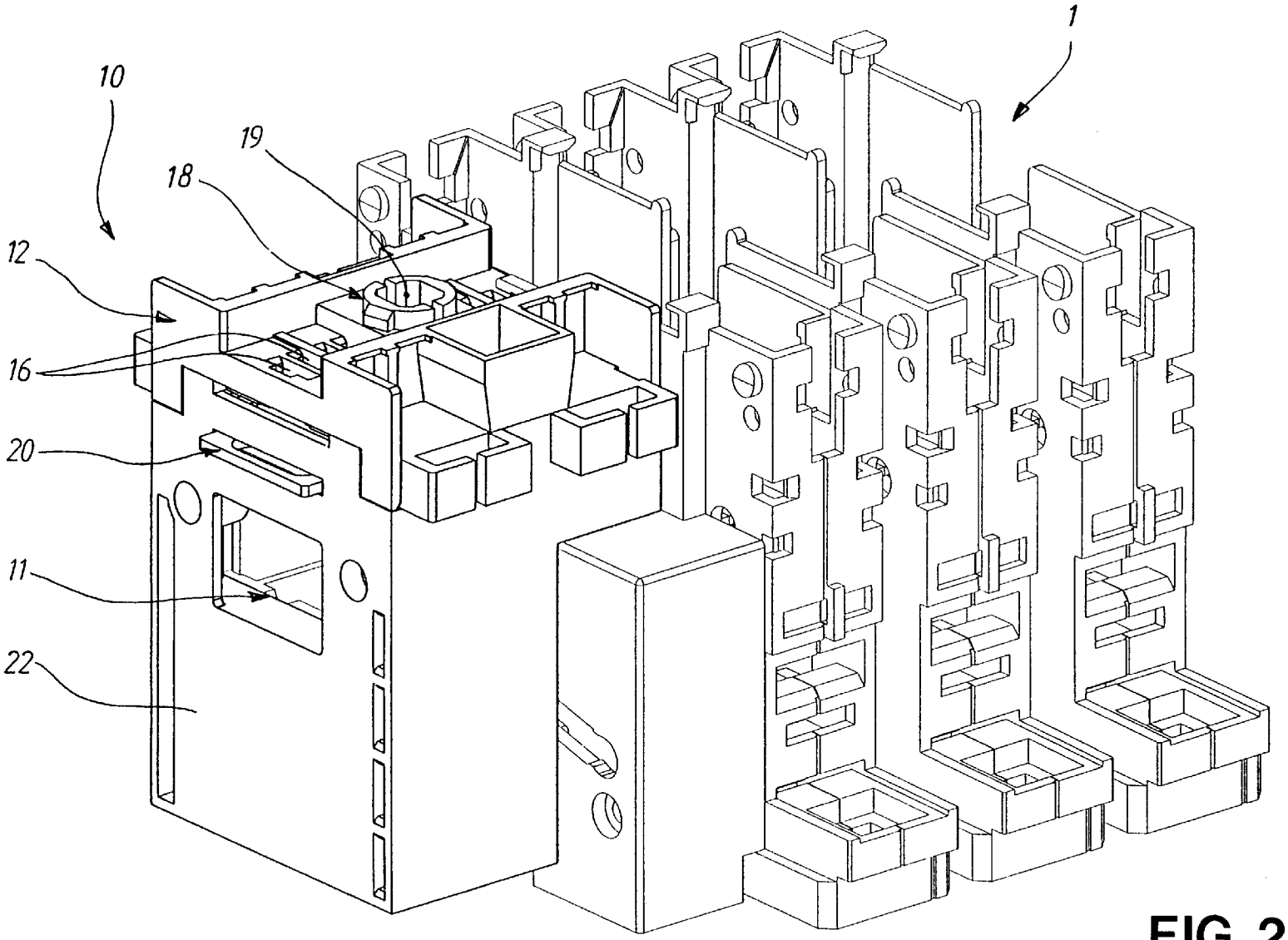
Figure 3:
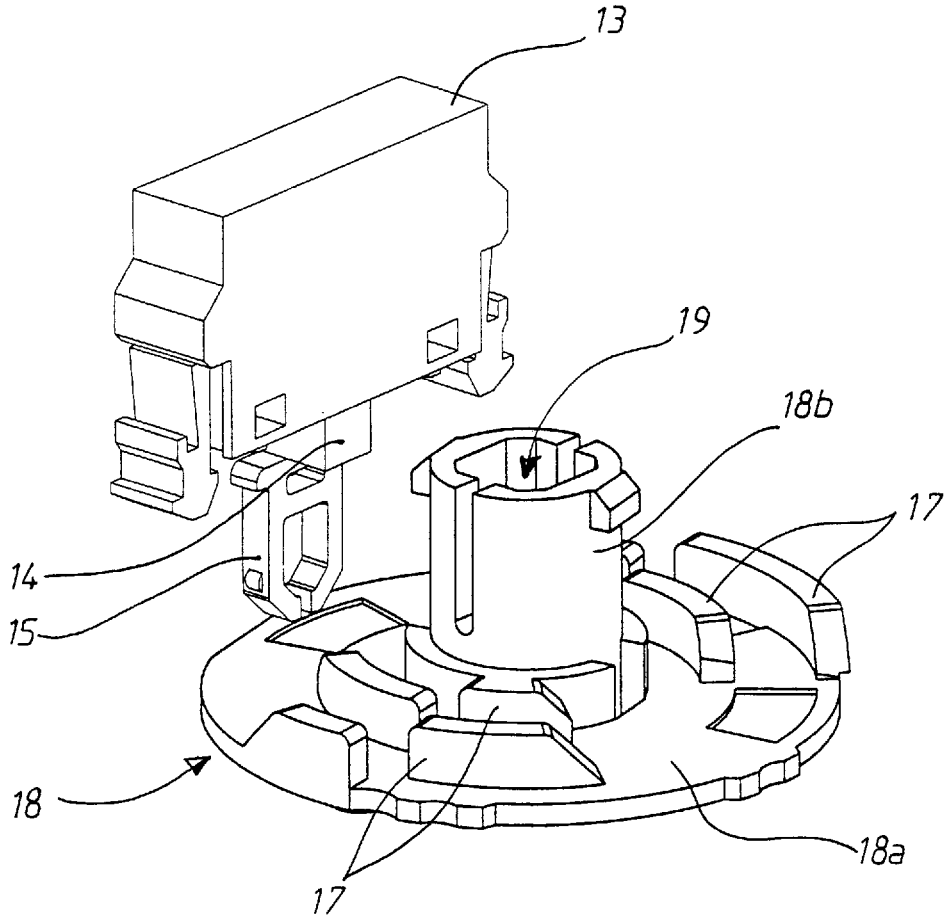

The present invention and its advantages will be more clearly understood from the following description of a non-restrictive example of embodiment, with reference to the attached drawings in which:

FIG. 1 shows an exploded perspective view of a preferred embodiment of a part of the unit according to the invention, in particular the accessory device, FIG. 2 shows a perspective view of a switch-fuse unit combined with a control unit, FIG. 3 shows a perspective view of a detail of the unit according to the invention.

With reference to the figures and in particular to FIG. 1, the accessory device 10 is combined with a control block 11 for the switch-fuse unit's 1 auxiliary contacts (see FIG. 2), this unit being shown schematically.

The actual accessory device 10 is comprised of a support 12 which bears at least one and preferably several microswitches 13, e.g. four in the embodiment shown in FIG. 1. These microswitches each have a mobile actuator 14 the function of which is to activate the contacts accomodated inside these microswitches housing and control said auxiliary circuits. At least one and preferably two plungers 15, housed in appropriate receptacles 16 in the support 12, are associated with each of these mobile actuators 14. These plungers, which can slide in a direction perpendicular to the support's 12 plane, direction shown by the double arrow A, are designed to activate the actuators 14 in order to close or open the corresponding contacts. It has to be noted that each contactor in a microswitch can have one or two corresponding plungers 15. The control possibilities are different in the two cases, as will be specified later on.

The plungers 15 are positioned to correspond with at least one and preferably several activation cams 17 arranged on the upper surface of a rotating part 18 mounted on a rotating shaft (not shown) which is inserted in the control box and the outer end of which is provided with a handle, lever or any other element allowing the user to control the switch-fuse by selecting positions using this handle, this lever or this other element.

The rotating part 18 comprises a disk 18*a* which bears the activation cams 17, arranged in concentric circles centered on said center shaft (not shown) and a cylindrical drum 18*b* with a cross bore 19 the section of which matches that of this shaft. This section is substantially square, the part 18 is firmly attached to the center shaft and rotates with it.

The cams 17 constitute protuberances which are substantially perpendicular to the plane of the disk 18*a* of part 18.

Furthermore, the unit comprises a padlocking plate 20 placed between the control block 11 and the rotating part 18. It has a keyhole shaped opening 21 presenting a circular shaped part 21*a* and an elongated part 21*b* with a square or rectangular section. The diameter of the part 21*a* is at least equal to the diagonal of the square section of said rotating shaft and the section of the elongated part 21*b* is substantially equal to one side of the square section of this shaft. When the rotating shaft crosses through the opening 21 in the part 21*a,* it can rotate freely whereas it is locked if it crosses through the opening 21 in the part 21*b*. The padlocking plate 20 slides between a first position corresponding to the free rotation of the rotating shaft and a second position which corresponds to the locking of the shaft.

From an operating point of view, the function selection handle mounted on the end of the rotating shaft is in principle designed to have three stable positions: a first position marked "0" for which the switch-fuse unit's contacts are open, a second position marked "1" for which the switch-fuse unit's contacts are closed and a third position marked "test" which makes it possible to test the auxiliary circuits without closing the switch-fuse unit's main contacts.

The working principle of the accessory device 10 is based on controlling the microswitches by means of the plungers 15 activated by the cams 17 borne by the disk 18*a* of the rotating part 18. As mentioned previously, the plungers 15 can be activated by a cam 17, but one single actuator 14 can be associated with two plungers 15. Each cam 17 preferably has an approach slope in the form of an oblique ramp and a right side opposite the ramp, which makes it possible to ensure that the corresponding contacts open/close quickly.

One of the cams 17 is arranged such that a plunger 15 is released when the switch-fuse unit switches from position "1" to position "0" causing the change of state of the auxiliary contact 13 before the main contacts open.

The cams are arranged in such a way that the microswitches 13 can be activated when the handle for selecting the functions is in position "1" or in the "test" position.

This construction offers the advantage of being compact, easily accessible, allowing a change in the configuration to be made by means of the plungers 15 and the initial configuration to be chosen according to the customers' requirements. It also makes it possible to suit all switching logics. For the manufacturer, the fact of having only one product reference facilitates storage and cuts costs. Finally, the unit with its accessory device requires a minimum amount of space.

A protective shroud 22 is designed to cover the control block 11, the rotating part 18 and the padlocking plate 20. This shroud is also used for storing unused plungers 15 and the directions for use.

This invention is not restricted to the example of embodiment described, but can be widened to include any modification or variation which is obvious for the expert.

I claim:

1. Switch-fuse unit (1) provided with a control block (11) to activate auxiliary circuits, this control block being provided with a rotating shaft fitted with a handle for selecting the unit's functions, characterised in that it comprises an accessory device (10) mounted on the control block (11) and combined with said rotating shaft, this accessory device having a support (12) provided with at least one receptacle (16) designed to house at least one plunger (15) designed to cooperate with a mobile actuator (14) of at least one microswitch (13) associated with an auxiliary circuit and being provided with a rotating part (18) mounted on said rotating shaft, this part being fitted with at least one activation cam (17) designed to activate the said plunger (15).

2. Unit according to claim 1, wherein the support (12) is provided with several receptacles (16) and two plungers (15), housed in two adjacent receptacles, are associated with the same mobile actuator (14) of a microswitch.

3. Unit according to claim 1, wherein the rotating part (18) comprises several activation cams (17) arranged in concentric circles.

4. Unit according to claim 3, wherein the rotating part (18) comprises a disk **(18*a*) bearing the activation cams (17), and a cylindrical drum (18*b*)** which said rotating shaft crosses through.

5. Unit according to claim 4, wherein said cylindrical drum has a cross bore (19) with a square section the dimensions of which match those of the section of said rotating shaft.

6. Unit according to claim 3, wherein each activation cam (17) corresponds to a plunger (15).

7. Unit according to claim 1, wherein it comprises a plate for padlocking (20) said rotating shaft.

8. Unit according to claim 7, wherein the padlocking plate (20) is placed between the rotating part (18) and the control block (11).

9. Unit according to claim 8, wherein the padlocking plate (20) has an opening (21) which said rotating shaft crosses through, this opening having a circular shaped part **(21*a*) allowing the shaft to rotate freely and an elongated part (21*b*)** with a square or rectangular section which locks this shaft.

10. Unit according to claim 7, wherein the padlocking plate (20) slides between a first position corresponding to the free rotation of the rotating shaft and a second position which corresponds to the locking of the shaft.

* * * * *